United States Patent [19]

Knox et al.

[11] 4,181,454

[45] Jan. 1, 1980

[54] PILE WIPER SEAL

[75] Inventors: Lloyd C. Knox; Steven G. Streich, both of Duncan, Okla.

[73] Assignee: Halliburton Company, Duncan, Okla.

[21] Appl. No.: 926,365

[22] Filed: Jul. 20, 1978

[51] Int. Cl.[2] ..... E02B 17/00; E02D 5/14

[52] U.S. Cl. ..... 405/227; 405/224

[58] Field of Search ..... 405/223, 227, 204, 208, 405/224; 277/88

[56] References Cited

U.S. PATENT DOCUMENTS

| | | | |
|---|---|---|---|
| 4,024,723 | 5/1977 | Mayfield et al. | 405/227 |
| 4,052,861 | 10/1977 | Malone | 405/227 |
| 4,095,807 | 6/1978 | Janot et al. | 277/88 X |

*Primary Examiner*—Dennis L. Taylor

*Attorney, Agent, or Firm*—James R. Duzan; John H. Tregoning

[57] ABSTRACT

A pile wiper seal assembly for sealing the annulus between either a jacket leg or pile sleeve and a pile inserted therethrough of a marine platform, the pile wiper seal assembly comprising annular seal member means, upper end shoe means secured to the inner surface of either the jacket leg or pile sleeve having a recess receiving therein the upper portion of the annular seal member means and lower end shoe means secured to the inner surface of either the jacket leg or pile sleeve having a recess receiving therein the lower portion of the annular seal member means whereby the upper end shoe means and lower end shoe means retain the annulus seal member means in either the jacket leg or pile sleeve.

7 Claims, 4 Drawing Figures

PILE WIPER SEAL

This invention relates to an improved annular wiper seal which is used to prevent the ingress of foreign material from the sea floor into a jacket leg or pile sleeve of a marine platform when driving a piling through the jacket leg or pile sleeve. To secure a marine platform to the sea floor piling is usually driven through the jacket legs and/or pile sleeves in the sea floor with the annulus between the pile and jacket leg and/or pile sleeve being filled with grouting material to secure the pile and jacket leg and/or pile sleeve together throughout their length above the sea floor.

When a platform is lowered to the sea floor, the jacket legs and/or pile sleeves will settle into the sea floor with the debris from the sea floor being prevented from entering the jacket legs and/or pile sleeves by means of diaphrams installed on the bottom thereof. Subsequently, upon driving a pile through the jacket leg and/or pile sleeve when the diaphram is ruptured, unless prevented, the inrush of debris from the sea floor and mud entrained in water will fill the annulus through the ruptured diaphram. If the annulus between a pile and jacket leg and/or pile sleeve is filled with debris and mud, it will be necessary to clean the annulus before the grouting thereof to ensure filling of the annulus with grouting material and the proper bonding of the grouting material to the pile and jacket leg and/or pile sleeve.

Usually, an annular wiper seal is installed above the diaphram to seal the annulus between the pile and jacket leg and/or pile sleeve to prevent the debris and mud from the sea floor rushing into the annulus when the diaphram is ruptured by the piling being driven therethrough. When the annulus between the pile and jacket leg and/or pile sleeve is being filled with grouting material, the annular grout seal may also help support the grout column.

One typical type prior art annular wiper seal as described in U.S. Pat. No. 3,533,241 comprises an elastomeric wiper which is reinforced by means of layers of fabric therein extending from its inner periphery to its outer periphery being wrapped about an annular reinforcing member having a circular cross-sectional shape retained within the outer periphery of the wiper. The wiper is secured to the jacket leg and/or pile sleeve by means of a pair of annular flat plates which protrude from the jacket leg and/or pile sleeve each plate having a semi-circular groove therein to receive a portion of the outer periphery of the wiper having the circular cross-sectionally shaped reinforcing member therein. The top annular flat plate of the pair of annular flat plates is secured to the jacket leg and/or pile sleeve by means of welding with the pair of annular flat plates being secured to each other by a plurality of bolts extending through apertures in the outer periphery of the pair of annular flat plates.

While this typical prior art seal is generally reliable in service, it requires careful wrapping of the layers of fabric about the annular circular cross-sectional shaped reinforcing member during the wiper construction process, requires the machining of semi-circular shaped grooves in the flat annular plates to receive the outer periphery of the wiper therein, and the use of a separate pile guide means to prevent damaging of the wiper when a pile is being inserted therethrough.

Another typical type prior art wiper as illustrated in U.S. Pat. No. 3,570,259 comprises a plurality of wire reinforcing members embedded in elastomeric material. The wiper is held in position in the jacket leg and/or pile sleeve by means of two annular bands which are welded in position and have an annular channel which receives the bent ends of the wire reinforcing members embedded in the elastomeric material. A separate pile guide member is welded in the jacket leg and/or pile sleeve above the wiper to guide the pile therethrough upon insertion.

While of relatively simple construction, the wiper requires the handling and accurate placement of a large number of wire reinforcing members during the wiper construction process. The wiper also requires the use of a separate pile guide member to prevent the pile from damaging the wiper or its securing means when a pile is being inserted therethrough thereby requiring an extra welding operation to be performed during installation.

In contrast to the prior art wipers, the present invention comprises a reinforced elastomeric member which is easily constructed and is retained in position in the jacket leg and/or pile sleeve by semi-annular members which require no machining and are formed using simple metal forming techniques.

Figure 1:
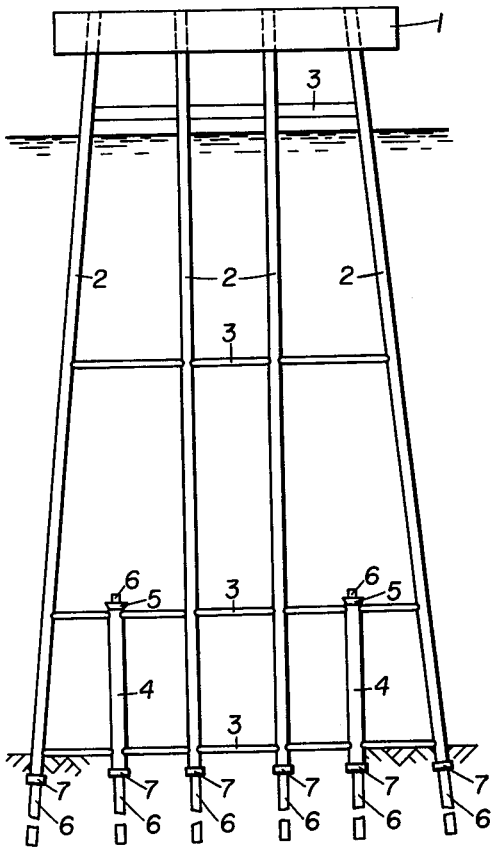
FIG. 1 is a side elevational view of an offshore platform having jacket legs and pile sleeves between the jacket legs resting on the bottom of a body of water.

Referring to FIG. 1, a marine platform 1 having tubular supporting legs 2 between which horizontal reinforcing members 3 are connected in the usual manner. Tubular piling guides or piling sleeves 4, which may have flared upper ends 5, are supported between the lower end portion of the legs 2 by the lower reinforcing members 3 and, with the legs, are adapted to rest upon or have their lower extremities slightly embedded in the bottom of a body of water.

The guides 4 or legs 2 are secured to the earth by driving piles 6 to refusal into the bottom of the body of water. Upon completion of the pile driving, the annulus between each guide 4 and/or leg and its associated pile 6 is filled with cement or grout to provide a unitary base structure.

Contained on the bottom of each leg 2 and guide sleeve 4 is a rupturable seal assembly 7.

Figure 2:
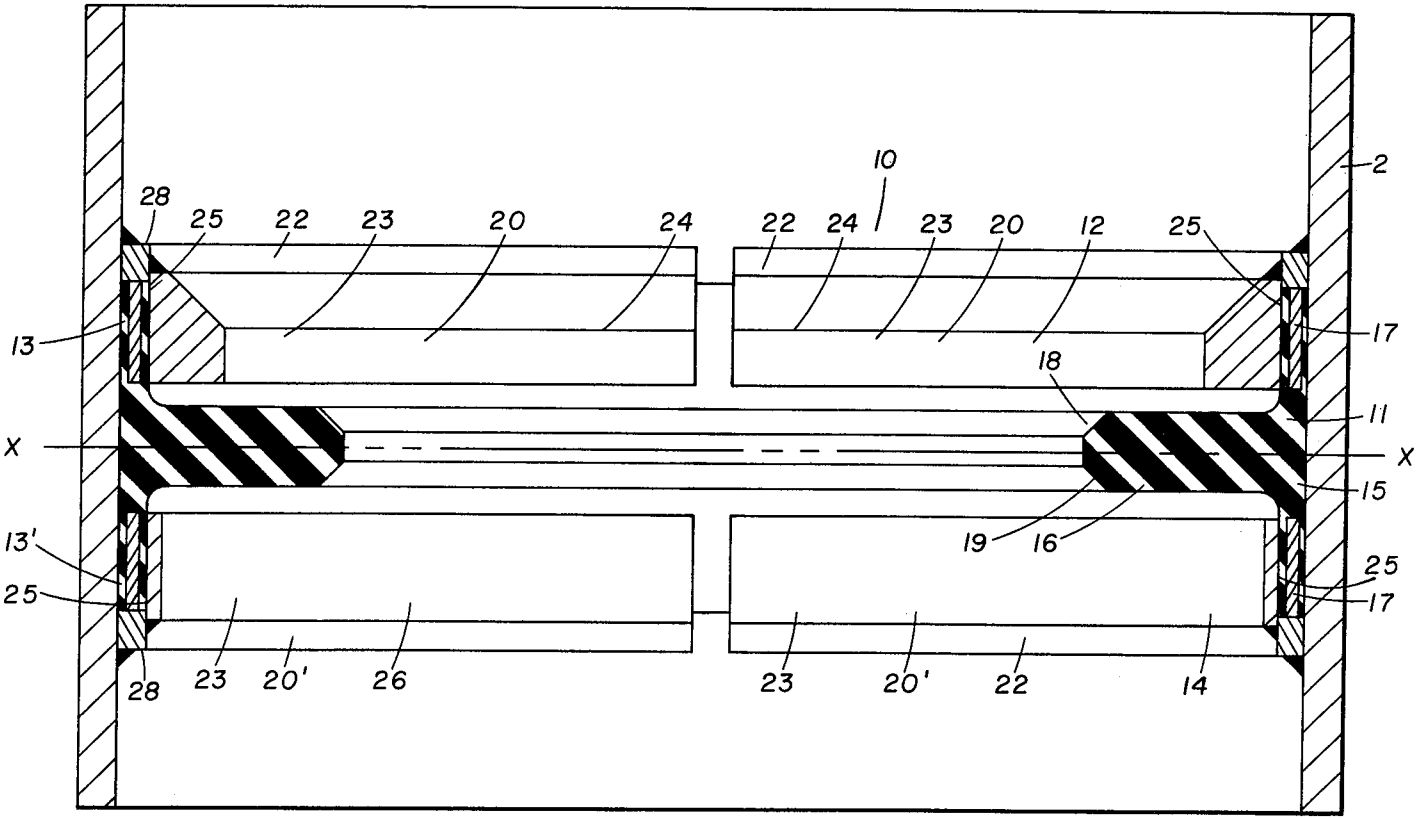
FIG. 2 is a cross-sectional view of an embodiment of the present invention.

Referring to FIG. 2, an embodiment of the present invention is shown. The wiper assembly 10 comprises an elastomeric wiper member 11 retained by an upper end shoe 12 and a lower end shoe 14. As shown, the wiper assembly 10 is installed in a jacket leg 2 of a marine platform 1.

The elastomeric wiper member 11 comprises an elastomeric member having a peripheral portion 15 and a sealing portion 16 formed substantially perpendicularly to the peripheral portion 15. The peripheral portion 15 of the wiper member 11 has annular reinforcing means 17 located therein to strengthen the peripheral portion 15. The annular reinforcing means 17 may comprise either a single annular member having a plurality of holes located therein to allow the elastomeric material of the wiper member 11 to flow therethrough or a pair of annular members retained in the upper 13 and lower 13′ portions of the peripheral portion 15 of the elastomeric wiper member 11. The annular reinforcing means 17 is generally rectangular in cross-sectional shape so that it may be easily fabricated from metal sheet material or other suitable type reinforcing materials.

The sealing portion 16 of the wiper member 11 is formed substantially perpendicularly to and located in the center of the inner surface of the peripheral portion 15 extending inwardly therefrom having chamfered annular surfaces 18 and 19 thereon to facilitate insertion of the pile therethrough. The sealing portion 16 of the wiper member 11 may extend any desired distance into the jacket leg 2 or pile sleeve 4 depending upon relative sizes of the jacket leg 2 or pile sleeve 4 and its associated pile 6. However, the sealing portion 16 should only engage the pile driven therethrough about its inner most periphery, the inner most periphery being defined as that portion of the sealing portion 16 which contains annular chamfered surfaces 18 and 19 and the adjacent portion of the sealing portion 16 thereto, to prevent undue stressing of the sealing portion 16 during the insertion of the pile 6 therethrough and the driving of the pile 6. Only a limited amount of engagement between the sealing portion 16 of the wiper member 11 and the pile inserted therethrough is desired since the wiper member 11 must be capable of sealing the annulus between the piling and jacket leg or pile sleeve during both upward and downward movement of the piling therethrough. It should be noted that upward movement of the pile through the wiper member 11 generally occurs when driving the pile into the sea floor. After each hammer blow on the pile, due to the natural resiliency of the pile and the geological formations into which the pile is being driven, the pile springs or bounces upwardly requiring the sealing portion 16 of the wiper member 11 to flex upwardly while maintaining sealing engagement with the pile being driven therethrough.

The wiper member 11 may be formed of any suitable elastomeric material, however, polyurethane is preferred. It should be noted that the wiper member 11 is symetrical about plane X—X to facilitate installation of the wiper member 11 in a jacket leg 2 or pile sleeve 4.

The upper end shoes 14 comprises a pair of semi-annular members 20. The semi-annular members 20 are formed having a first portion 22 and a second portion 23 being secured thereto by any convenient means; such as welding. The second portion 23 has a chamfered surface 24 on the upper end thereof to facilitate the insertion of the pile through the wiper member 11. Each semi-annular member 20 contains a recess 25 in which the upper 13 portion of the peripheral portion 15 of the wiper member 11 is retained when the upper shoe 12 and wiper member 11 are installed in a jacket leg 2 or pile sleeve 4.

Since the semi-annular members 20 are of simple geometeric shapes, they may be formed from plate or bar stock which has been rolled to the desired shape. Also, the chamfered surface 24 may be formed by merely flame cutting the edge of the second portion 23 before forming it to the desired shape thereby eliminating any machining of the upper end shoe 12.

The lower end shoe 14 comprises a pair of semi-annular members 20′. The semi-annular members 20′ are identical to the semi-annular members 20, except that the members 20′ do not contain a chamfered surface such as chamfered surface 24 on the members 20 and the second portion 23 of the semi-annular members 20′ are of reduced thickness to allow the wiper member 11 to fold thereagainst without damage by the pile 6. The chamfered surface is not required on the lower end shoe 14 since the pile is inserted through the upper shoe 12 and guided into position thereby. Also the recess 25 in the lower end shoe 14 retains the lower portion 13′ of the peripheral portion 15 when the lower end shoe 14 and wiper member 11 are installed in a jacket leg 2 or pile sleeve 4.

The upper end shoe 12 and lower end shoe 14 may be secured about surfaces 28 thereof to the jacket leg 2 or pile sleeve 4 by any suitable means, such as welding.

When the wiper assembly 10 is installed in the jacket leg 2, the outer peripheral surface of the peripheral portion 15 of the wiper member 11 contacts the inner surface of the jacket leg 2 and is substantially parallel thereto throughout a portion of its length.

Figure 3:
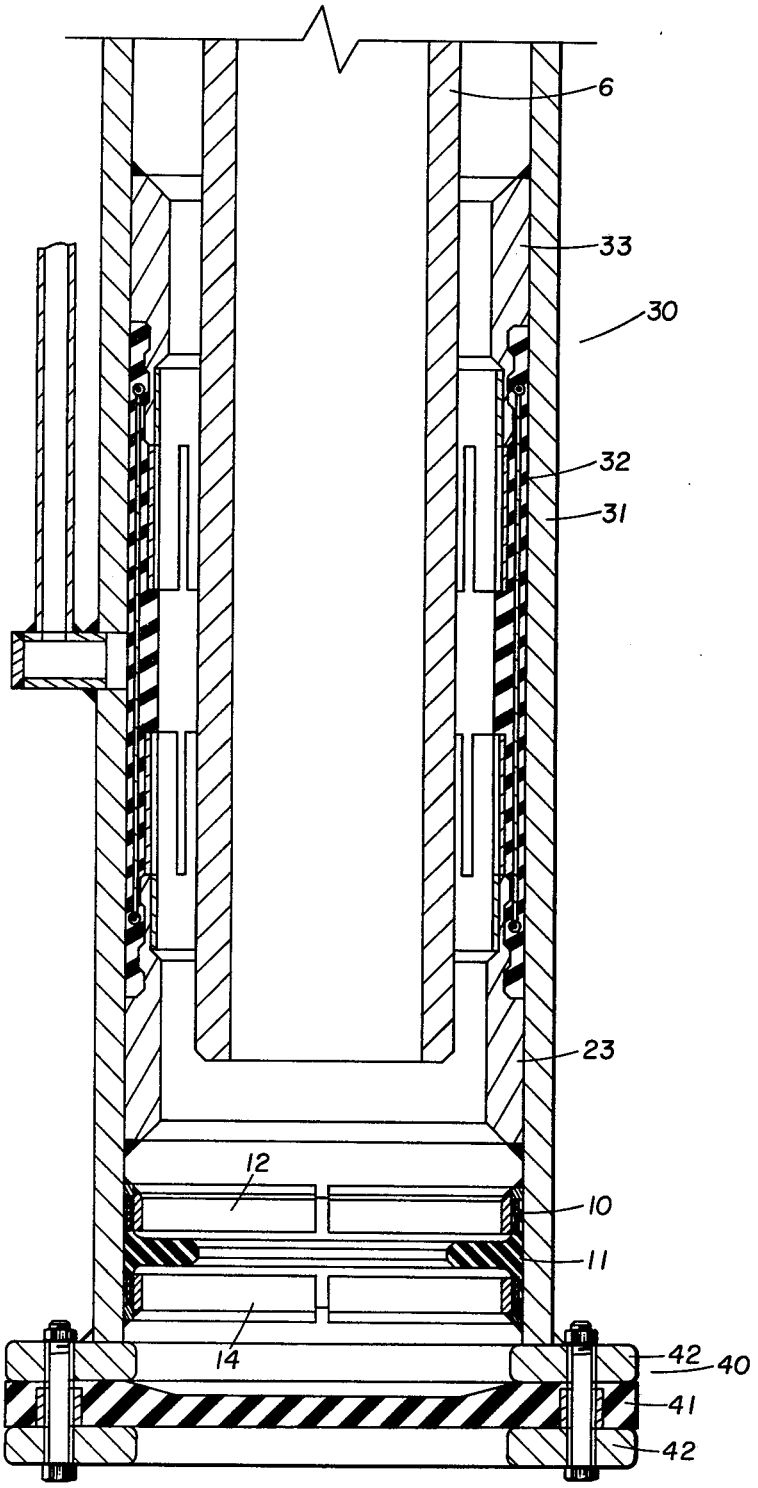
FIG. 3 is a cross-sectional view of the embodiment of the invention shown in FIG. 2 installed in a jacket leg or pile sleeve in conjunction with an inflatable packer and diaphram.

Referring to FIG. 3, the wiper assembly 10 is shown in conjunction with an inflatable packer assembly 30 and diaphram assembly 40. The wiper assembly 10 is shown installed in the extended case 31, which is secured to the lower end of a jacket leg 2 or pile sleeve 4 (not shown), of an inflatable packer 30 between the packer 30 and a diaphram assembly 40 secured to the end of the extended case 31 of the inflatable packer 30. The diaphram assembly 40 comprises a pair of flanges 42, the upper flange being secured to the extended case 31 of the inflatable packer 30, and diaphram member 41 being retained in sealing engagement between the flanges 42 by means of a plurality of bolts 43.

As shown, when the pile 6 is inserted through the wiper member 11, the wiper member 11 will seal the annulus between the pile 6 and extended case 31 of the inflatable packer 30 thereby preventing the entry of debris and mud entrained in water after the diaphram member 41 has been ruptured by driving pile 6 therethrough.

Figure 4:
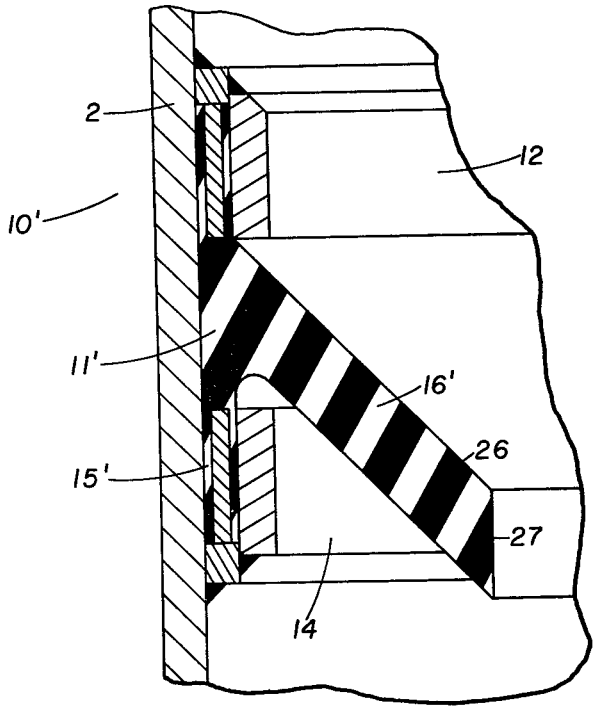
FIG. 4 is a broken cross-sectional view of a second embodiment of the present invention.

Turning to FIG. 4, an alternative embodiment of the present invention is shown. The wiper assembly 10′ comprises an elastomeric wiper member 11′ retained by an upper end shoe 12 and lower end shoe 14. The wiper assembly 10′ is installed in a jacket leg 2 of a marine platform 1.

The elastomeric wiper member 11′ comprises an elastomeric member having a peripheral portion 15′ and a sealing portion 16′ formed at an angle with respect to the peripheral portion 15′. The peripheral portion 15′ of the wiper member 11 has annular reinforcing means 17′ located therein to strengthen the peripheral portion 15′. The peripheral portion 15′ is identical to the peripheral portion 15 described hereinbefore and shown in FIG. 2.

The sealing portion 16′ of the wiper member 11′ is formed at an angle with respect to and secured in the center of the peripheral portion 15′ extending inwardly therefrom having a pile guiding surface 26 terminating in surface 27 which is parallel to the peripheral portion 15′. When installed in a jacket leg 2 or pile sleeve 4, the sealing portion 16′ of the wiper member 11′ is installed such that pile guiding surface 26 is always facing the top of the marine platform 1. The sealing portion 16′ of the wiper member 11′ may extend any desired distance into the jacket leg or pile sleeve 4 depending upon the relative sizes of the jacket leg 2 and pile sleeve 4 and its associated piling 6. However, the sealing portion 17 should only engage the pile driven therethrough about its inner most periphery, the inner most periphery being defined as that portion of the sealing portion 16 which contains surface 27 and adjacent portion of the sealing portion 16′ thereto, to prevent undue stressing of the sealing portion 16′ during the insertion of the pile 6 therethrough and the driving of the pile 6.

The wiper member 11′ may be formed of any suitable elastomeric material, however, polyurethane is preferred.

As can be easily seen, the present invention offers the following advantages:

Simplicity of wiper member construction;

Simplicity of end shoe construction requiring no machining thereof during manufacture;

Integral guide ring and upper end shoe configuration thereby eliminating a separate guide ring member;

Simplicity of attachment to a jacket leg or pile sleeve; and a reduced thickness lower shoe under the wiper seal to prevent damage to the wiper seal by a pile being driven therethrough.

Having thus described my invention, we claim:

1. A pile wiper seal assembly sealing the annulus between either a tubular jacket leg or tubular pile sleeve having a diaphragm installed thereon and a pile inserted therethrough of a marine platform having the base thereof resting on the bottom of a body of water, said pile wiper seal assembly being utilized to help prevent the debris and mud from the bottom of said body of water from rushing into the portion of the annulus above said pile wiper seal assembly when said diaphragm is ruptured by said pile, said pile wiper seal assembly comprising:

annular seal member means formed of elastomeric material having a solid peripheral portion and a solid sealing portion extending inwardly therefrom in continuous contact with the solid peripheral portion throughout their common periphery thereby forming an annular seal member means containing no voids therein, the peripheral portion of said annular seal member means comprising an annular shaped member extending in a direction substantially parallel to either said tubular jacket leg or said tubular pile sleeve along a portion of the length thereof having the outer surface engaging the inner surface of either said tubular jacket leg or said tubular pile sleeve and having annular substantially rectangular cross-sectionally shaped reinforcing means secured therein extending in a direction substantially parallel to either said tubular jacket leg or said tubular pile sleeve;

the sealing portion of said annular seal member means comprising an annular shaped member having the outer periphery secured to the inner surface of the peripheral portion of said annular seal member means with the peripheral portion extending on each side of the sealing portion wherein the portion of the peripheral portion of said annular seal member means extending above the sealing portion of said annular seal means comprises the upper portion thereof while the portion of the peripheral portion of said annular seal member means extending below the sealing portion of said annular seal member means comprises the lower portion thereof and having a bore therethrough the diameter thereof being smaller than the diameter of said pile before the insertion of said pile through said annular seal member means;

upper end shoe means secured to the inner surface of either said tubular jacket leg or said tubular pile sleeve having a recess therein receiving the upper portion of the peripheral portion of said annular seal member means; and lower end shoe means secured to the inner surface of either said tubular jacket leg or said tubular pile sleeve having a recess therein receiving the lower portion of the peripheral portion of said annular seal member means whereby said upper end shoe means and said lower end shoe means retain said annular seal member means in either said tubular jacket leg or said tubular pile sleeve and the annular substantially rectangular cross-sectionally shaped reinforcing means prevents the removal of the peripheral portion of said annular seal member means from said upper end shoe means and said lower end shoe means.

2. The pile wiper seal assembly of claim 1 wherein the outer periphery of the sealing portion of said annular seal member means is secured to substantially the center of the inner surface of the peripheral portion.

3. The pile wiper seal assembly of claim 1 wherein the sealing portion of said annular seal member means extends inwardly substantially perpendicularly to the peripheral portion of said annular seal member means.

4. The pile wiper seal assembly of claim 1 wherein the sealing portion of said annular seal member means extends inwardly at an angle with respect to the peripheral portion of said annular seal member means.

5. The pile wiper seal assembly of claim 1 wherein said annular seal member means is constructed of polyurethane elastomeric material.

6. A pile wiper seal assembly sealing the annulus between either a tubular jacket leg or tubular pile sleeve having a diaphragm installed thereon and a pile inserted therethrough of a marine platform having the base thereof resting on the bottom of a body of water, said pile wiper seal assembly being utilized to help prevent the debris and mud from the bottom of said body of water from rushing into the portion of the annulus above said pile wiper seal assembly when said diaphragm is ruptured by said pile, said wiper seal assembly comprising:

annular seal member means formed of polyurethane elastomeric material having a solid peripheral portion and a solid sealing portion extending inwardly therefrom in continuous contact with the solid peripheral portion throughout their common periphery thereby forming an annular seal member means containing no voids therein, the peripheral portion of said annular seal member means comprising an annular shaped member extending in a direction substantially parallel to either said tubular jacket leg or said tubular pile sleeve along a portion of the length thereof having the outer surface engaging the inner surface of either said tubular jacket leg or said tubular pile sleeve and having annular substantially rectangular cross-sectionally shaped reinforcing means secured therein extending in a direction substantially parallel to either said tubular jacket leg or said pile sleeve;

the sealing portion of said annular seal member means comprising an annular shaped member having the outer periphery secured in the center of the inner surface of the peripheral portion of said annular seal member means and extending inwardly therefrom substantially perpendicularly with respect to the peripheral portion of said annular seal member means with the peripheral portion extending on each side of the sealing portion wherein the portion of the peripheral portion of said annular seal member means extending above the sealing portion of the annular seal means comprises the upper portion thereof while the portion of the peripheral portion of said annular seal member means extending below the sealing portion of said annular seal member means comprises the lower portion thereof and having a bore therethrough the diameter thereof being smaller than the diameter of said pile before the insertion of said pile through said annular seal member means;

upper end shoe means secured to the inner surface of either said tubular jacket leg or said tubular pile sleeve having a recess therein receiving the upper portion of the peripheral portion of said annular seal member means; and lower end shoe means secured to the inner surface of either said tubular jacket leg or said tubular pile sleeve having a recess therein receiving the lower portion of the pheripheral portion of said annular seal member means whereby said upper end shoe means and said lower end shoe means retain said annular seal member means in either said tubular jacket leg or said tubular pile sleeve and the annular substantially rectangular cross-sectionally shaped reinforcing means prevents the removal of the peripheral portion of said annular seal member means from said upper end shoe means and said lower end shoe means.

7. A pile wiper seal assembly sealing the annulus between either a tubular jacket leg or tubular pile sleeve having a diaphragm installed thereon and a pile inserted therethrough of a marine platform having the base thereof resting on the bottom of body of water, said pile wiper seal assembly being utilized to help prevent the debris and mud from the bottom of said body of water from rushing into the portion of the annulus along said pile wiper seal assembly when said diaphragm is ruptured by said pile, said pile wiper seal assembly comprising:

annular seal member means formed of polyurethane elastomeric material having a solid peripheral portion and a solid sealing portion extending inwardly therefrom in continuous contact with the solid peripheral portion throughout their common periphery thereby forming an annular seal member means containing no voids therein, the peripheral portion of said annular seal member means comprising an annular shaped member extending in a direction substantially parallel to either said tubular jacket leg or said tubular pile sleeve along a portion of the length thereof having the outer surface engaging the inner surface of either said tubular jacket leg or said tubular pile sleeve and having annular substantially rectangular cross-sectionally shaped reinforcing means secured therein extending in a direction substantially parallel to either said tubular jacket leg or said pile sleeve;

the sealing portion of said annular seal member means comprising an annular shaped member having the outer periphery secured in the center of the inner surface of the peripheral portion of said annular seal member means and extending inwardly therefrom at an angle with respect to the peripheral portion of said annular seal member means with the peripheral portion extending on each side of the sealing portion wherein the portion of the peripheral portion of said annular seal member means extending above the sealing portion of the annular seal means comprises the upper portion thereof while the portion of the peripheral portion of said annular seal member means extending below the sealing portion of said annular seal member means comprises the lower portion thereof and having a bore therethrough the diameter thereof being smaller than the diameter of said pile before the insertion of said pile through said annular seal member means;

upper end shoe means secured to the inner surface of either said tubular jacket leg or said tubular pile sleeve having a recess therein receiving the upper portion of the peripheral portion of said annular seal member means; and lower end shoe means secured to the inner surface of either said tubular jacket leg or said tubular pile sleeve having a recess therein receiving the lower portion of the peripheral portion of said annular seal member means whereby said upper end shoe means and said lower end shoe means retain said annular seal member means in either said tubular jacket leg or said tubular pile sleeve and the annular substantially rectangular cross-sectionally shaped reinforcing means prevents the removal of the peripheral portion of said annular seal member means from said upper end shoe means and said lower end shoe means.

* * * * *

UNITED STATES PATENT AND TRADEMARK OFFICE

CERTIFICATE OF CORRECTION

PATENT NO. : 4,181,454

DATED : Jan. 1, 1980

INVENTOR(S) : Lloyd C. Knox and Steven G. Streich

It is certified that error appears in the above-identified patent and that said Letters Patent are hereby corrected as shown below:

Column 1, lines 19, 21, 24, 31, 34; Column 2, line 32; and Column 4, lines 20, 24, 26, 28, 35; the word "diaphram" is misspelled and should read --diaphragm.--

Signed and Sealed this

*Twentieth* Day of *May 1980*

[SEAL]

*Attest:*

SIDNEY A. DIAMOND

*Attesting Officer*

*Commissioner of Patents and Trademarks*